US005456191A

United States Patent [19]

Hall

[11] Patent Number: 5,456,191

[45] Date of Patent: Oct. 10, 1995

[54] ADJUSTABLE HEIGHT COUNTER WEIGHTED MANUAL LIFT TABLE

[76] Inventor: Donald M. Hall, P.O. Box 1247, Progress St., Kingston, N.Y. 12401

[21] Appl. No.: 86,279

[22] Filed: Jun. 25, 1993

[51] Int. Cl.[6] ..... A47B 9/00

[52] U.S. Cl. ..... 108/147; 248/162.1

[58] Field of Search ..... 108/147, 144, 108/146, 50; 248/162.1, 648, 406.2, 188.2, 188.3

[56] References Cited

U.S. PATENT DOCUMENTS

| | | | |
|---|---|---|---|
| 1,888,478 | 11/1932 | Steidl | 108/146 X |
| 2,672,386 | 3/1954 | Segal et al. | 108/147 |
| 2,792,944 | 5/1957 | Drommer . | |
| 3,855,946 | 12/1974 | Bales . | |
| 3,915,102 | 10/1975 | Barron | 100/146 X |
| 4,292,903 | 10/1981 | Hockema | 108/146 |
| 4,351,245 | 9/1982 | Laporte | 100/144 X |
| 4,894,600 | 1/1990 | Kearney . | |
| 4,948,205 | 8/1990 | Kelley | 108/50 X |
| 4,969,403 | 11/1990 | Schwartz et al. . | |
| 4,981,085 | 1/1991 | Watt . | |
| 5,107,775 | 4/1992 | Langlais et al. . | |

FOREIGN PATENT DOCUMENTS

| | | | |
|---|---|---|---|
| 904938 | 2/1954 | Germany . | |
| 2818016 | 11/1979 | Germany . | |
| 3114366 | 11/1982 | Germany | 100/144 |

*Primary Examiner*—Jose V. Chen
*Attorney, Agent, or Firm*—Shlesinger Arkwright & Garvey

[57] ABSTRACT

The adjustable height work surface includes a support for supporting a work surface spaced from and relative to the ground, an adjustment member associated with the support and with the work surface for moving the work surface for varying the distance between the work surface and the ground, and a lock-out member for preventing operation of the adjustment member when at least a predetermined force is being exerted on the work surface.

20 Claims, 6 Drawing Sheets

FIG. 8A
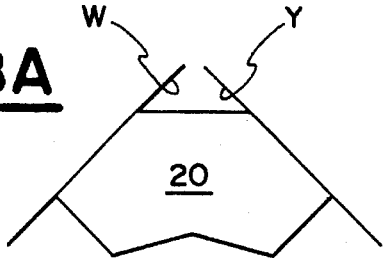
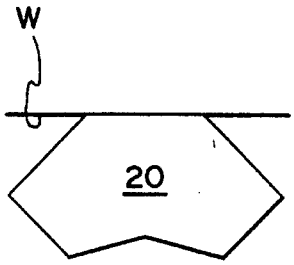
FIG. 8B
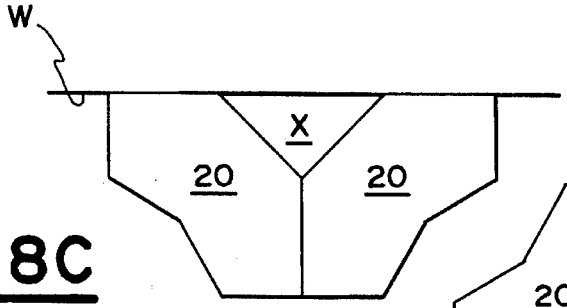
FIG. 8C
FIG. 8D
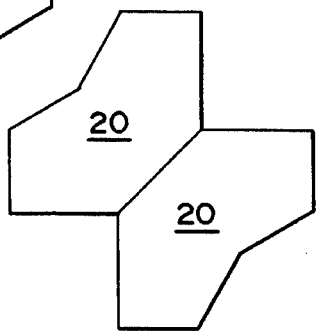
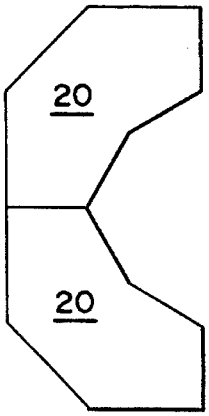
FIG. 8E
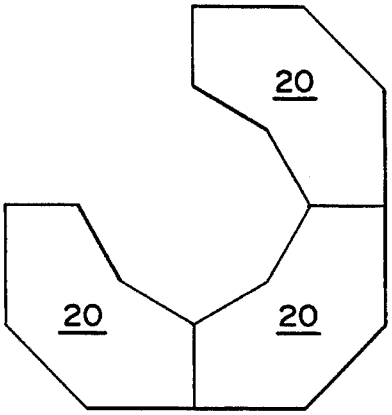
FIG. 8F
FIG. 8G
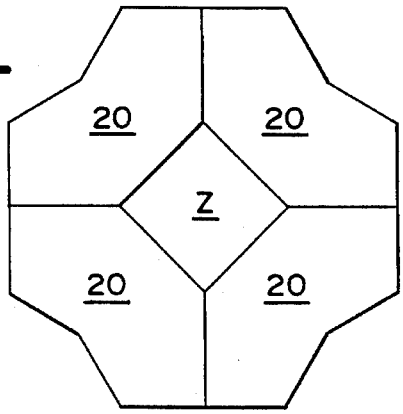

ADJUSTABLE HEIGHT COUNTER WEIGHTED MANUAL LIFT TABLE

FIELD OF THE INVENTION

This invention relates to an adjustable height table, and particularly to adjustable height tables having work surfaces thereon that can be manually vertically adjusted.

BACKGROUND OF THE INVENTION

Various attempts have been made to provide tables and other work surfaces having mechanisms for varying the height of the work surface relative to the floor and to the user.

The majority of conventional adjustable height tables are either simple in construction yet require lots of manual labor to change the heights thereof or are extremely complex electrical and electromechanical devices that are prohibitively expensive for most applications.

U.S. Pat. No. 5,107,775 to Langlais et al. discloses a school desk having hollow, tubular legs with a variety of vertically spaced holes drilled therethrough. Mating outer sleeves are provided having similar holes through which screws are inserted and secured by nuts. To adjust the height of the work surface of the desk, each sleeve must be released, changed in height, and reattached to its associated tubular leg.

German Patent No. 904,938 to Görtz et al., discloses an adjustable height table leg including an inner support foot which can be variably fixedly retained relative to the tubular leg by use of a number of spring-loaded pins which engage with appropriate holes in an outer hollow leg. Although this device may be more easily manually adjusted than the Langlais et al. device, described immediately above, it is still labor-intensive and unsuitable for applications where frequent height adjustment of a work surface is required.

U.S. Pat. No. 2,792,944 to Drommer discloses a bookkeeping stand having pins mounted on a spring-loaded member for being normally biased into engagement with a plurality of vertically spaced holes extending along the length of the Drommer corner posts (legs). The Drommer device is simple and efficient, yet likely inappropriate for carrying heavy loads on its work surface.

A U-shaped adaptive work station is disclosed in U.S. Pat. No. 4,894,600 to Kearney. The Kearney work tabletop is height adjustable, yet its movement is dependent on an outside source of electrical power. A suggestion is made in the Kearney patent that a safety mechanism which stops downward travel to prevent injuries to a user's legs when seated with his or her legs underneath the work station be provided. No disclosure is made in Kearney as to how one might make a substantially purely mechanical height adjustable work station.

Accordingly, there is a need for a height adjustable work surface or table which is easily used, carries heavy loads, is reliable, and overcomes the drawbacks of the prior art devices.

The use of the term "table" is for convenience only, as all movable work surfaces and table-like devices are intended to be within the scope of the invention. Likewise, the use of the terms "ground", "floor", and "support", for example, are intended to encompass all supporting surfaces and other objects which support the invention and relative to which the working surface or tabletop according to the invention will move.

OBJECTS AND SUMMARY OF THE INVENTION

It is a first object of the invention to provide a device which has a height adjustable work surface.

Another object of the invention is to provide an adjustable height table having a work surface thereon which is vertically movable relative to the floor.

Yet another object of the invention is to provide an adjustable height table having a tabletop which is movable when less than a predetermined weight is placed on the tabletop.

A still further object of the invention is to avoid the presence of electrical components, including wires, in the inventive table.

A further object of the invention is to provide an adjustable height table usable regardless of the availability of external power sources.

Yet another object of the invention is to provide an adjustable height table having a work surface which can be moved only when less than a predetermined force is being applied to the work surface.

It is yet another object of the invention to provide an adjustable height table having a mechanism for normally biasing the work surface substantially vertically upwardly.

A yet still further object of the invention is to provide an adjustable height work surface overcoming the drawbacks of conventional adjustable tables.

Still another object of the invention is to provide an adjustable height table having a self-contained operating system.

Another object of the invention is to provide an adjustable height table which is simple to manufacture, requires few moving parts, and, hence, has increased reliability as compared with conventional adjustable tables.

A further object of the invention is to avoid the presence of electrical components, such as motors, electromechanical controls and wires, which may come in direct contact with liquids.

Another object of the invention is to provide an adjustable height table which is engineered for use in all industries and throughout the world regardless of available electrical and other power sources.

Yet another object of the invention is to provide an adjustable height table which is mechanically stable, even when placed on an irregular surface.

A yet still further object of the invention is to provide an adjustable height table which has a compact construction.

A still further object of the invention is to provide an adjustable height work surface which is usable in a food-preparation environment, owing to its enhanced hygienic construction.

A yet still further object of the invention is to provide an adjustable height work surface which can be easily moved without the use of conventional metal bearings and rollers.

Another object of the invention is to provide an adjustable height table having a positive locking device for arresting up and down movement, and which locking device is unlockable only when less than a predetermined weight is placed on the work surface.

Still another object of the invention is to provide an adjustable height table which is strong enough to hold heavy objects, such as a side of beef.

A still further object of the invention is to provide a work surface having an outline configured for agreeing with ergonomically suitable movements of a typical worker so that a worker can reach all parts of the work surface without straining.

Yet another object of the invention is to provide an adjustable height table having an outline configured for mating with other similarly configured adjustable height tables so that 2, 3, 4, or more such tables can be placed side-by-side in a manner calculated to provide a larger, usable, collective work surface, and to reduce the floor space required per worker.

A further object of the invention is to provide an ergonomically configured work surface having an outline and sides engineered to mate with standard, right angle adjoining walls of a room so that intelligent use may be made of the space in the conventional corner of a room.

Another object of the invention is to enhance work efficiency.

Yet another object of the invention is to provide an adjustable height table having individual components which are readily removed for maintenance and cleaning and which table is, hence, more hygienic than existing devices.

In summary, therefore, the invention is directed to adjustable height work surface systems and adjustable height tables which operate easily, without outside power sources, accurately, and are ergonomic and hygienic.

In one embodiment of the invention, the adjustable height work surface includes a support for supporting a work surface spaced from and relative to the ground, an adjustment member associated with the support and with the work surface for moving the work surface for varying the distance between the work surface and the ground, and a lock-out member for preventing operation of the adjustment member when at least a predetermined force is being exerted on the work surface.

The invention will be further described with reference to the following drawings.

BRIEF DESCRIPTION OF THE DRAWINGS

FIGS 8A–8G are schematic plan views of various groups of one or more tables according to the invention.

DETAILED DESCRIPTION OF THE INVENTION

Figure 1:
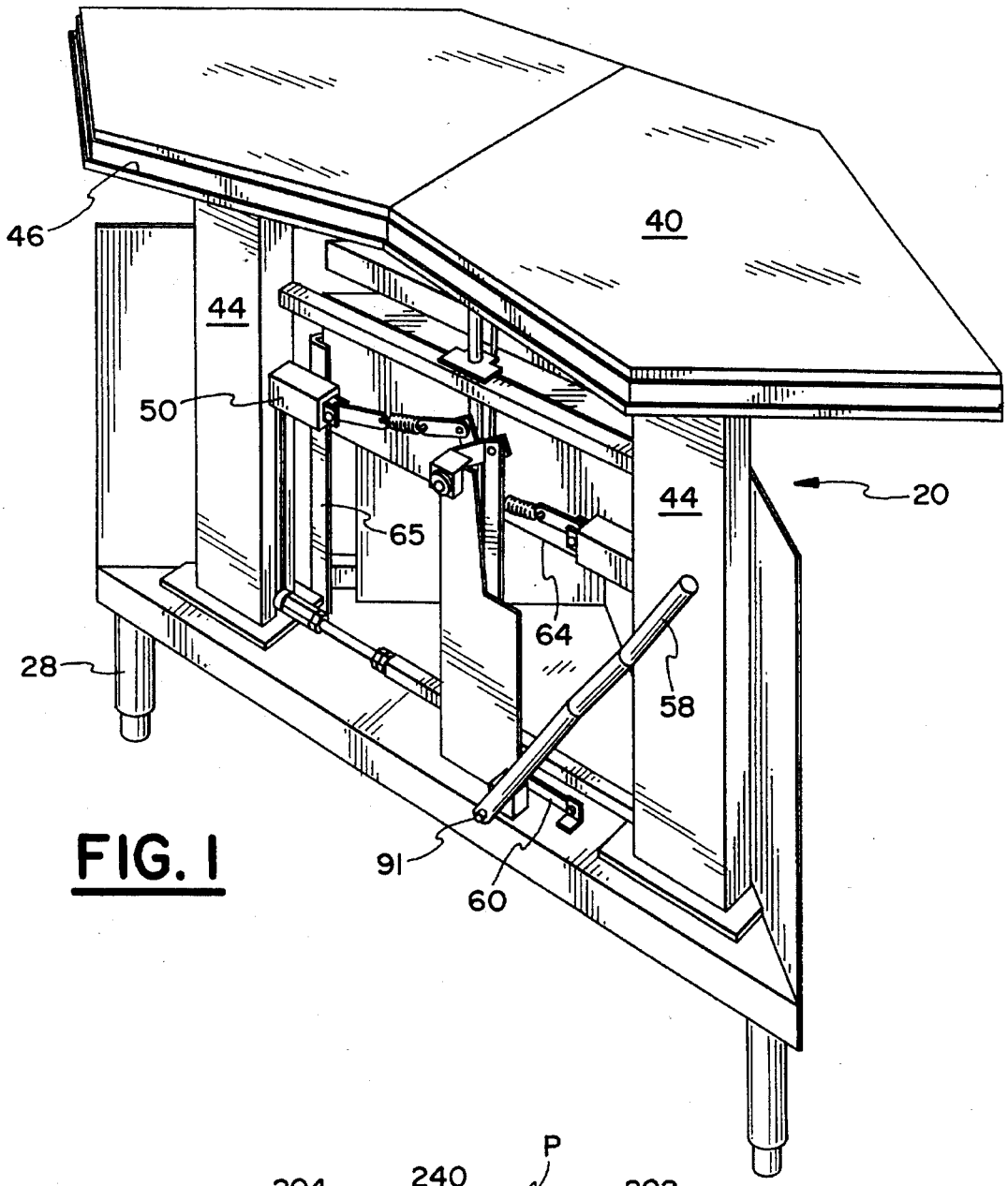
FIG. 1 is a perspective view showing an adjustable height table according to the invention.

Turning to FIGS. 1–4, there is shown an adjustable height table 20 according to a preferred embodiment of the invention. Adjustable height table 20 includes a main frame 24 and downwardly extending legs 28. It has been found that three such legs 28 serve to stabilize adjustable height table 20 on most surfaces. Optional leg extensions 30 which can be made height adjustable for varying the effective length of legs 28 can be provided for use on irregular surfaces.

A work surface or tabletop 40 is carried by one or more supports or pylons 44. Table top 40 may have a slope from the rear to the front for causing liquids to run off into a trough 46.

A lock-out mechanism 50 including a spring-loaded locking pin 54 is actuated by a release handle or control arm 58. An optional stabilizer 60 carries excessive forces applied to handle 58. A counterweight 64 guided by one or more guides 65 is provided to balance out (i.e., counterbalance) the forces and weight of tabletop 40 and the components which move therewith, as described in detail below with regard to lock-out mechanism 50.

Counterweight 64 is mechanically connected to tabletop 40 by means of a pulley 68 guiding a cable 72 which is connected to a lower side 76 of tabletop 40 by means of an extension 82 having a cable-receiving eyelet 86. Preferably, a guide element 88 which may conveniently be attached to one or more of supports 44 or to another part of main frame 24, guides extension 82.

Figure 2:
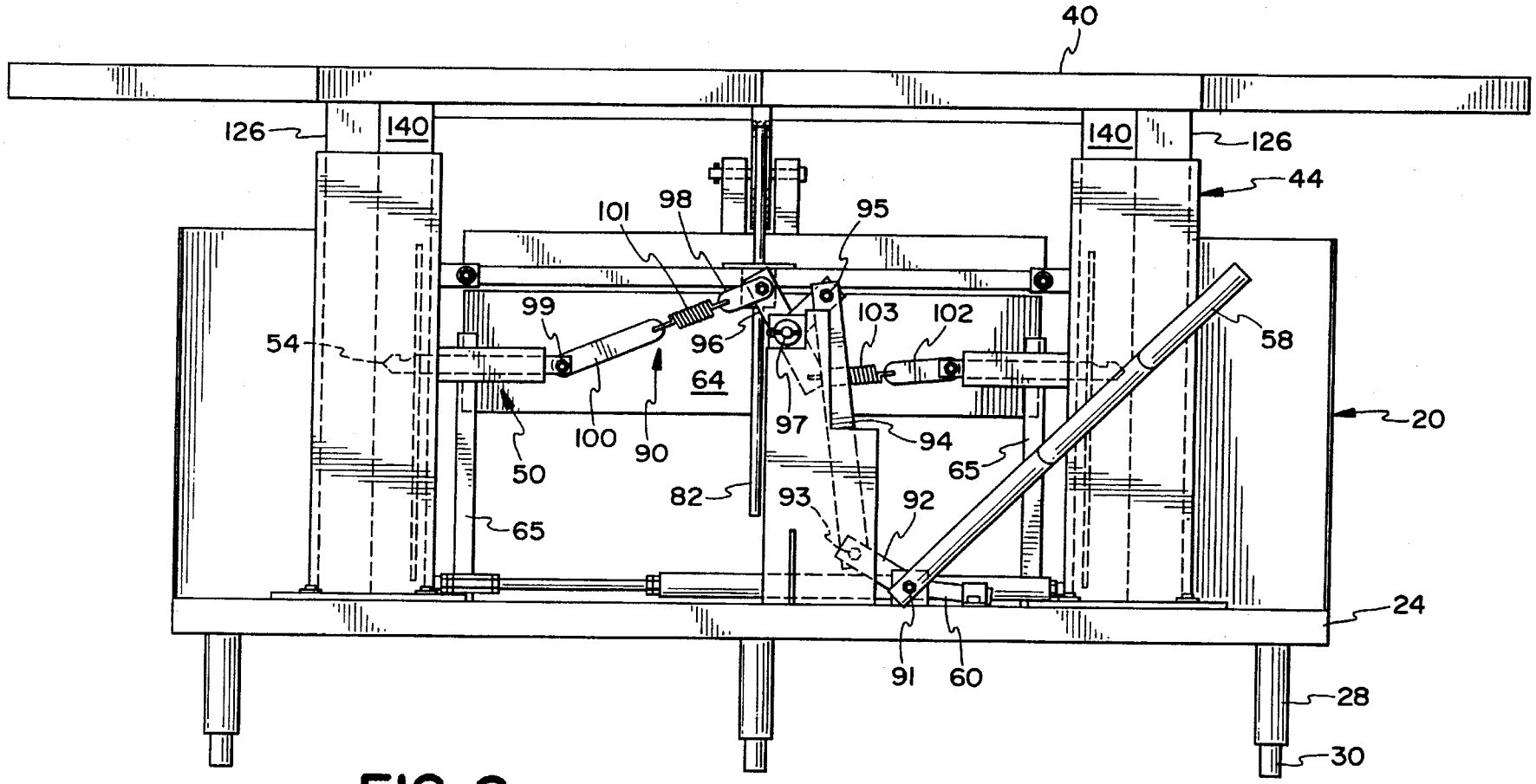
FIG. 2 is a front elevational view of the adjustable height table FIG. 1.

A series of linkages 90 translates the rotation of handle 58 about a pivot point 91 into substantially linear movement which concurrently retracts and inserts both left and right spring-loaded locking pins 54 when handle 58 is rotated from side to side as viewed in FIG. 2, for example.

The series of linkages 90 includes a straight link 92 fixed relative to handle 58 and rotatable about pivot 91.

A further pivot pin 93 serves as a pivot point about which a link 94 rotates relative to link 92. Link 94 likewise rotates about a pivot 95 and relative to a substantially T-shaped link member 96. T-shaped link member 96 is rotatable about a pivot pin 97 and has one of its free ends pivotably attached to a further link 98. A pivot element 99 rotatably attaches a link 100 to locking pin 54. Link 100 is connected to link 98 by a spring 101 having its free ends movably attached to the respective links.

The right hand spring-loaded locking pin 54, as viewed in FIG. 2, is pivotably attached to a link 102 which, in turn, is movably attached to T-shaped link 96 by means of a spring 103.

Figure 6:
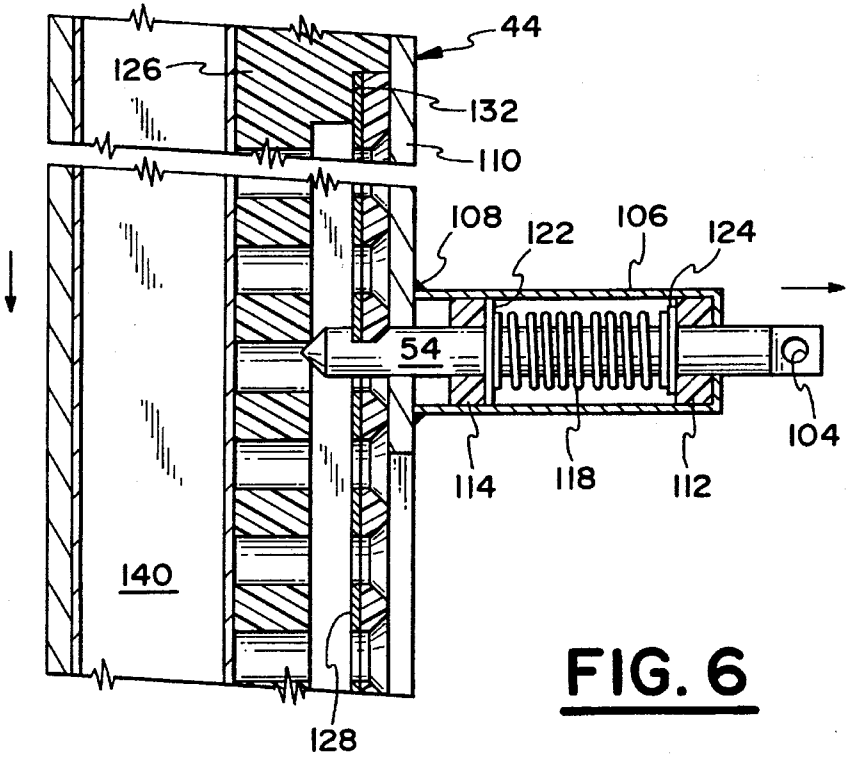
FIG. 6 is a view similar to FIG. 5, showing a part of the lock-out mechanism in a different position.
Figure 5:
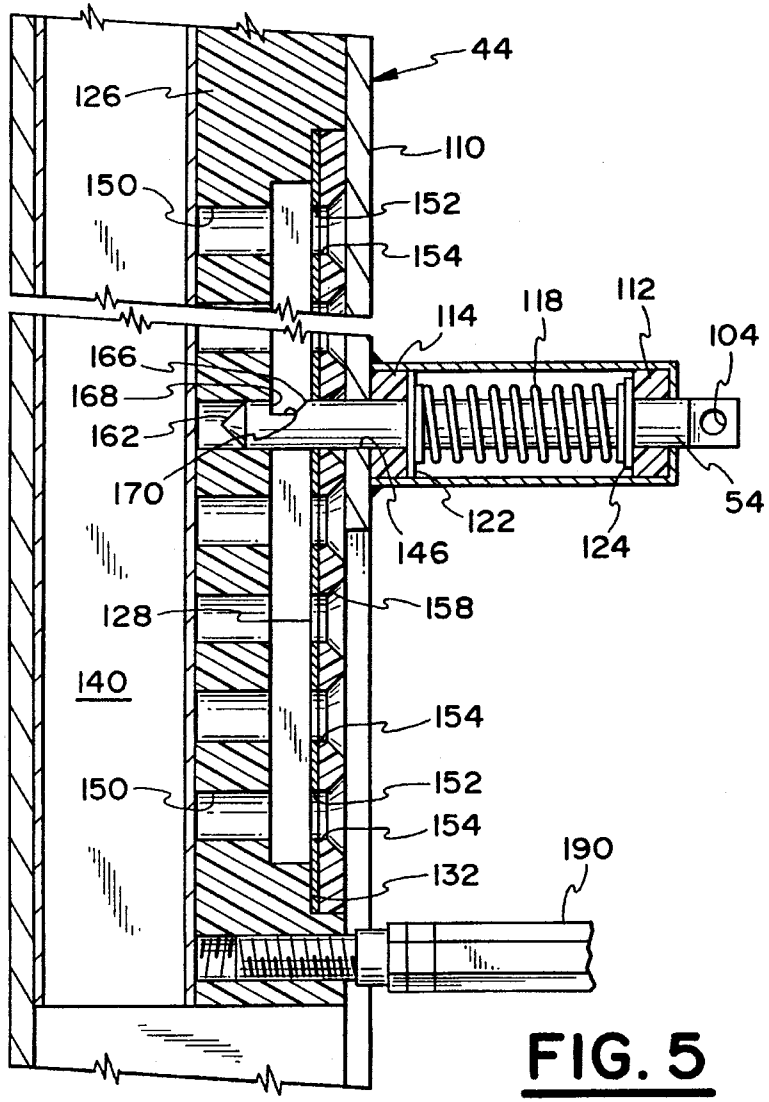
FIG. 5 is an enlarged, partial view of a preferred embodiment of a lock-out mechanism shown in FIG. 1, on an enlarged scale.

Turning to FIGS. 5 and 6, the structure of the spring-loaded locking pin 54 and its cooperation with elements of supports 44 for governing and arresting up and down movement of work surface 40 is illustrated in greater detail.

Figure 3:
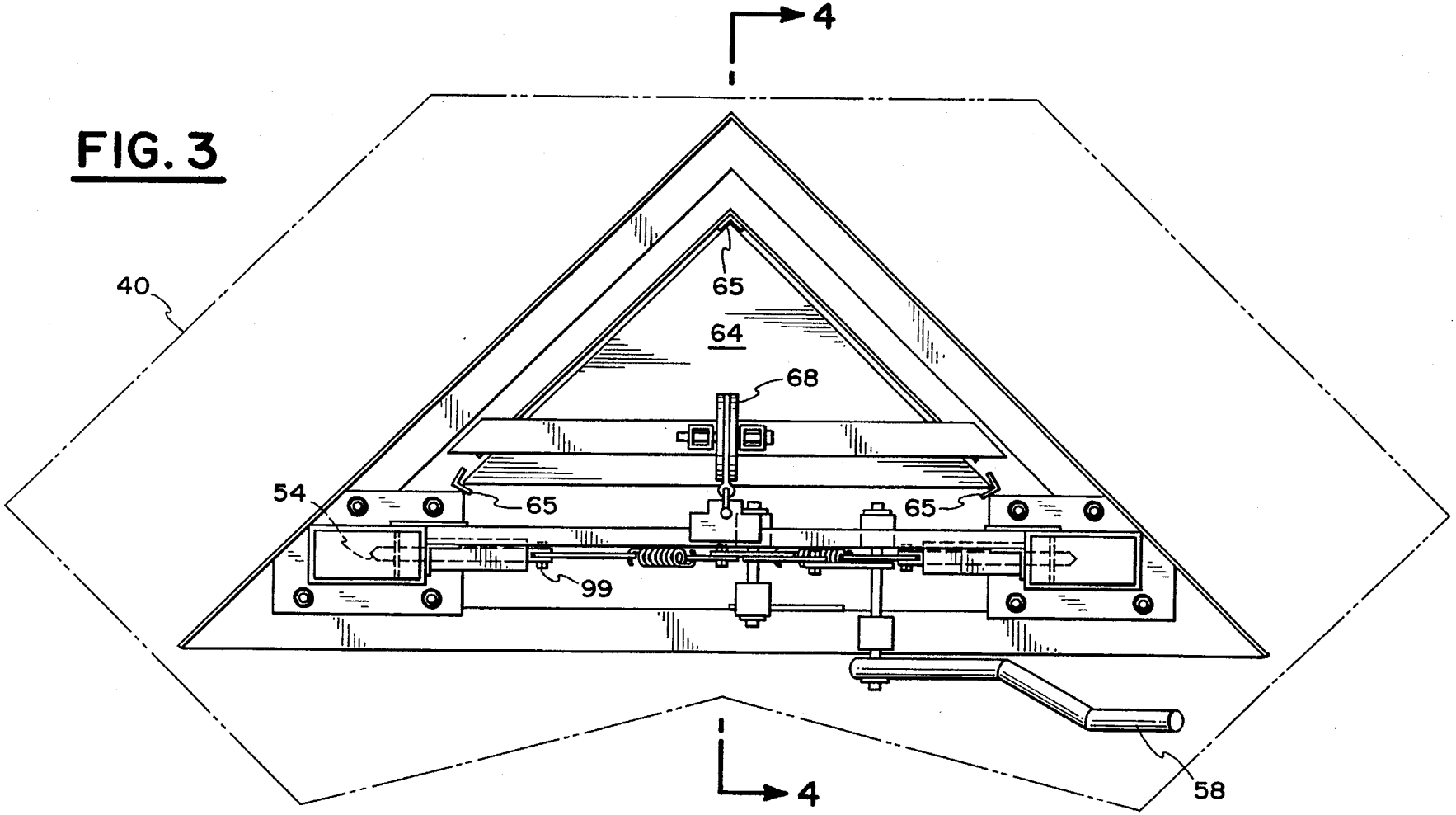
FIG. 3 is a top, plan view of the adjustable height table of FIG. 1.
Figure 4:
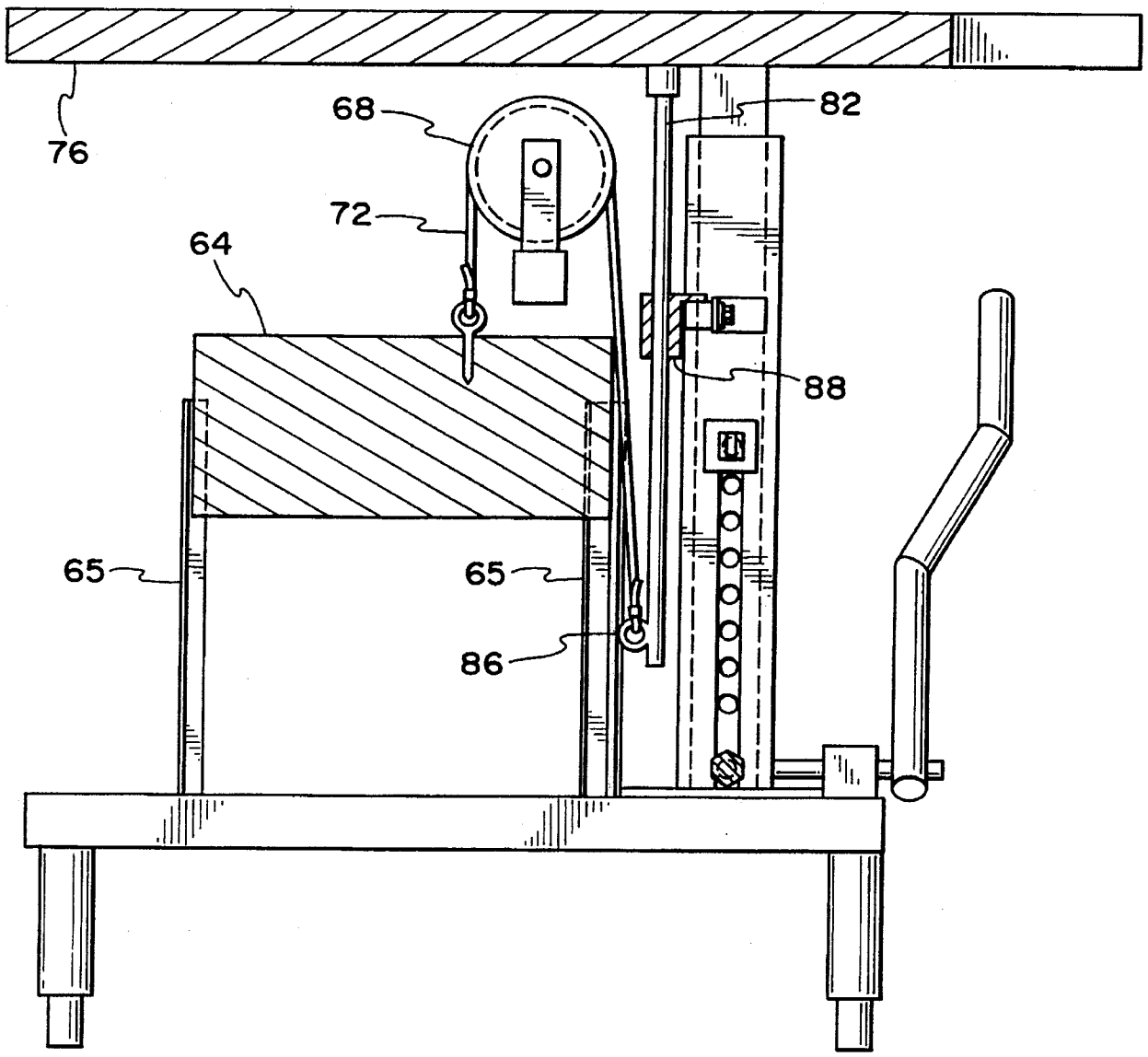
FIG. 4 is a cross sectional view of the adjustable height table according to the preferred embodiment, taken along line 4—4 of FIG. 3.

A through hole 104 is defined in locking pin 54 and is configured for rotatably receiving pivot element 99 (FIGS. 2 and 3). A pin housing 106 is fixed by one or more welds 108 to a wall 110 of support 44. Preferably, one or more bushings 112, 114 are provided to stabilize and guide locking pin 54 throughout its length of travel. A spring 118 provides a biasing force to locking pin 54 by means of a fixed washer 122 welded to locking pin 54 and located at one free end of spring 118. A free washer 124 is located between spring 118 and bushing 110 and freely movable relative thereto.

A slidable plastic bearing element or poly block 126 is slidably received in each support 44. A wear-resistant plate 128 is received in a pocket 132 defined in plastic bearing element 126. A sliding support column 140, such as a steel tube, abuts bearing element 126 and is connected to work surface 40. Both support column 140 and bearing element 126 move relative to wall 110.

Wall 110 includes a bore 146 dimensioned for receiving spring-loaded locking pin 54. A passage 150 is defined in plastic bearing element 126, is configured for receiving locking pin 54, and is aligned with a hole 152 bored through plate 132. Hole 152 receives locking pin 54 and is likewise aligned with aperture 154 defined in bearing element 126. Aperture 154 includes a bevelled opening 158 configured for guiding a tapered free end 162 of pin 54.

Spring-loaded locking pin 54 further includes an inclined ramp 166 and a locking wall 168, both of which are engineered for working with plate 128 and cooperate to define a groove 170. Groove 170 is preferably located substantially only in the upper portion of locking pin 54 facing tabletop 40, for reasons described in detail below regarding the operation of the invention. However in some applications it may be desirable to have said groove be located in the bottom or side of the pin.

An optional adjustment bar 190 extends between lower portions of plastic bearing elements 126 for fine-tuning the relationship between the bearing elements 126 and supports 44. Adjustment bar 190 is unnecessary when the adjustable height table 20 according to the invention is produced with close tolerances.

Figure 7:
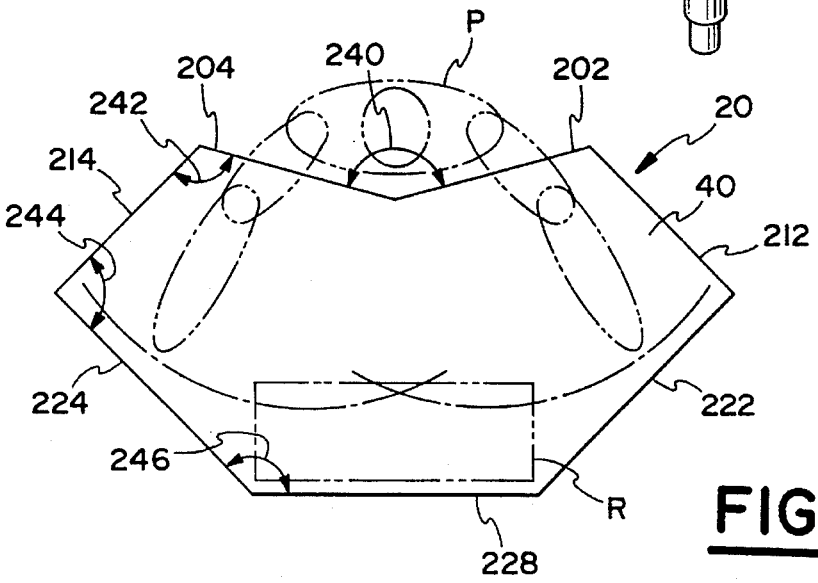
FIG. 7 is a schematic top, plan view of the adjustable height table according to the invention.

FIG. 7 illustrates the ergometric advantage offered by the chevron-shaped configuration of tabletop 40 of the adjustable height table 20 according to a preferred embodiment of the invention.

An operator P standing adjacent left front face 202 and right front face 204 of tabletop 40 utilizes his or her arms to access the entire working surface of tabletop 40 without straining. Thus, operator efficiency is increased while fatigue and injuries are decreased. A region R is used for the convenient storage of material and also may serve as an area over which an auxiliary device may project for access by worker P. For example, in the food service industry a "boat rack" containing plastic (e.g. polystyrene) meat trays ("boats") is conveniently located on a free-standing shelf system extending over region R.

A left side face 212 and a right side face 214 are respectively connected to a left rear face 222 and a right rear face 224. A rear face 228 spans left and right rear faces 222, 224.

Preferably, an angle 240 defined between left front face 202 and right front face 204 has an included angle in the range of 120°–160°, and preferably, about 150°. An angle 242 defined between right front face 204 and right side face 214 is preferably about 130° when angle 240 is 150°. An included angle 244 defined between right side face 214 and right rear face 224 is preferably about 90°. An included angle defined between right rear face 224 and rear face 228 is preferably about 135°.

In a working model of adjustable height table 20 according to the invention, good results were obtained with the length of right side face 214 being about 20 inches, the length of right rear face 224 being about 28 inches, and the length of rear face 228 being about 28 inches. The angles were the above preferred angles.

The length and angles of the respective elements are substantially the same on the left side of adjustable height table 20.

FIGS. 8*a*–8*g* illustrate a variety of configurations involving one or more of inventive tables 20.

FIG. 8*a* shows the manner in which adjustable height table 20 fits in a corner defined by a wall W and an adjoining wall Y.

FIG. 8*b* shows the placement of table 20 against a single wall W.

FIG. 8*c* illustrates the manner in which two tables 20 can be abutted together adjoining a wall W, and defining a space X therebetween. If desired an additional machine, storage shelf, or other items may be located in space X for use by one or both of the workers using tables 20.

FIG. 8*d* shows the manner in which the rear faces of adjacent tables 20 abut.

FIG. 8*e* is an illustration of a further configuration involving two tables 20.

FIG. 8*f* shows how three tables 20 can define a substantially C-shaped working area. A fourth table 20 could be placed in an analogous manner to define a complete O-shaped work area involving 4 tables 20.

FIG. 8*g* shows how four tables can be abutted so that an open space Z is defined centrally thereof, in which manner four different workers could access materials and tools located in space Z, while each worker has his or her own work surface and space.

OPERATION

In use, the operator adjusts the height of work surface 40 by rotating handle 58 to retract spring-loaded locking pins 54 from passage 150, hole 152, and aperture 154, in turn. Once tapered free end 162 of locking pin 54 has substantially cleared aperture 154, work surface 40 can be moved up or down.

The movement of work surface 40 is easily performed with one hand, thanks to the weight of counterweight 64 acting to balance out the weight of tabletop 40 via the vertically downward acting force of counterweight 64 being exerted through cable 72, around pulley 68 and through extension 82. By giving counterweight 64 a mass substantially the same as the mass of work surface 40 and the components which move therewith, such as bearing element 126 and sliding support column 140, the effective weight of work surface 40 from the operator's perspective approaches zero. In other words, counterweight 64 and associated components have a weight selected to balance out the weight of work surface 40 and its associated components, and are a means for substantially counterbalancing the weight of work surface 40 by exerting a predetermined amount of force on work surface 40.

After the operator has moved work surface 40 to a desired height, the handle 58 is released, and pin 54 enters the closest one of apertures 154 and, hence, the other aligned holes in plate 128 and bearing element 126.

In the event that tapered free end 162 fails to enter one of apertures 154 owing to its having been stopped at a position between adjacent apertures 154, then vertical movement of work surface 40 when force is applied, such as by the addition of a product or by the placement of the worker's hand on top of work surface 40, will cause vertical movement of bearing block 126 and will result in complete insertion of pin 54 in its proper holes. This is accomplished by bevelled opening 156 cooperating with spring loaded tapered free end 162 of pin 54, as will be readily appreciated.

To prevent unexpected lowering of work surface 40 when a heavy object is placed thereon, for example, groove 170 cooperates with plate 128 to preclude complete retraction of locking pin 54 and, hence, unwanted movement of work surface 40.

Thus, as best seen in FIG. 6, if an operator attempts to lower work surface 40 when more than a predetermined weight is placed thereon, a load exceeding the predetermined weight will cause work surface 40 along with bearing element 126 and support column 140 to lower. The lowering of bearing element 126 causes captured plate 128 to slide down inclined ramp 166. Further retraction of pin 54 (movement to the right as viewed in FIG. 6) abuts plate 128 against locking wall 168 of groove 170 for precluding further movement of pin 54. By providing groove 170 substantially only on the upper half of pin 54, two advantages are realized: first, pin 54 is unlikely to inadvertently lock when table top 40 is being moved up or down as there is no downwardly opening groove portion to engage a portion of plate 128; second, pin 54 has less material removed for the establishing of groove 170 and is thus stronger in the vicinity of groove 170.

An adjustable height table 20 according to a preferred embodiment of the invention has been made in which tabletop 40 and associated moving components weigh about 100 pounds, and counterweight 64 had a weight of about 115 pounds. In that working model when about a 25 pound weight was placed on tabletop 40, the locking pin 54 was prevented from retracting when release handle 58 was rotated, thanks to engagement of plate 128 with groove 170. Table top 40 had a slope from the rear face 228 to the front of about 2°–3° relative to the horizontal. A range of slopes of about 0°–10° is expected, different slopes offering ergometric advantages depending on the task being performed.

It is contemplated that conventional bearings and other sliding surfaces will be used instead of the disclosed slidable plastic bearing element.

It is likewise contemplated that springs can be substituted for the counterweight and that an electric version of the adjustable height table be made in which some or all of the components are electrical and electronic, such as electric motors, and electrical sensor mechanisms for determining whether a weight is on the work surface and the work surface should be prevented from moving.

It is further contemplated that hydraulic and/or electromechanical versions of the adjustable height work table be used where environmental conditions warrant such.

In addition, multiple pulleys instead of the disclosed single pulley will be used in versions of the invention where a different mechanical advantage is warranted.

Furthermore, it is contemplated that a single supporting leg, double supporting legs, or four or more supporting legs be used depending on the application.

The material of the tabletop is preferably a plastic, hygienic material when the adjustable height table is used in the delicatessen, butchery, and grocery business. In bakeries, it is expected that a stainless steel top may be used. A wooden version for carpenters and residential do-it-yourselfers is envisioned. In environments where water is less a problem, it is contemplated that aluminum sliding support columns be used, as well as aluminum for other elements of the main frame, to reduce the overall weight of the adjustable height table.

Other shapes, materials, and configurations are contemplated as substitutes for the disclosed concrete, substantially triangular shaped counterweight.

It is likewise envisioned that a variable force braking means be provided for varying the force required to move the work surface downwardly, for example, so that the operator may change the predetermined force or weight required to actuate the lock-out mechanism for preventing movement of the tabletop.

Finally, it is expected that standard, rectangular configurations for the tabletop, as well as circular, square, and other standard tabletop shapes be used instead of the preferred chevron-shaped tabletop.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

It is further contemplated that this invention could include a tapered pin without a lock out groove with a resultant simplified version of the linkage for pin extraction, this could include the use of cables for pin movement.

It is further contemplated that this invention could include a normally downward biased work surface, or an unbiased work surface.

What is claimed is:

1. An adjustable height table, comprising:

a) a work surface having a weight;

b) means associated with said work surface for supporting said work surface relative to a floor;

c) means operatively associated with said supporting means and with said work surface for substantially counterbalancing the weight of said work surface by exerting a predetermined amount of force on said work surface, the predetermined amount of force being substantially equal to the weight of said work surface;

d) means operatively associated with said supporting means for establishing different variably fixed vertical distances between said work surface and the floor; and e) the height of said work surface relative to the floor being adjustable only when a weight weighing less than a predetermined weight is disposed on said work surface.

2. An adjustable height table as defined in claim 1, wherein a) said counterbalancing means includes means for normally biasing said work surface substantially vertically upwardly.

3. An adjustable height table as defined in claim 1, wherein:

a) said supporting means includes a leg.

4. An adjustable height table as defined in claim 1, wherein:

a) said counterbalancing means includes a counterweight associated with said work surface.

5. An adjustable height table as defined in claim 1, wherein:

a) said counterbalancing means for exerting a predetermined amount of force includes a counterweight.

6. An adjustable height table, comprising:

a) a work surface having a weight;

b) a support associated with said work surface, said support having a working end disposed adjacent said work surface and a supporting end spaced apart from said working end;

c) means operatively associated with said support and with said work surface for counterbalancing the weight of said work surface, said counterbalancing means substantially balancing out the weight of said work surface by exerting a predetermined amount of force on said work surface;

d) means operatively associated with said support for establishing different variably fixed vertical distances between said work surface and said supporting end; and e) means operatively associated with said vertical distance establishing means for precluding operation of said vertical distance establishing means when a weight greater than a predetermined weight is being applied to said work surface for precluding vertical movement of the work surface when greater than the predetermined weight is being exerted on said work surface.

7. An adjustable height table as defined in claim 6, wherein:

a) said work surface includes a substantially horizontal V-shaped element.

8. An adjustable height table as defined in claim 6, wherein:

a) said counterbalancing means operates without electricity.

9. An adjustable height work table, comprising:

a) a work surface having a weight;

b) a support disposed adjacent said work surface, said support supporting said work surface spaced from and relative to the ground;

c) a counterbalance, said counterbalance including a counterweight operatively associated with said work surface, said counterweight substantially balancing out the weight of said work surface by exerting a predetermined amount of force on said work surface, said predetermined amount of force being substantially equal to the weight of said work surface;

d) a height adjustment member associated with said support and with said work surface for adjusting the height of said work surface, and said height adjustment member including an element for variably fixing the distance between said work surface and the ground; and e) a lock-out member for preventing operation of said height adjustment member when a weight weighing more than a predetermined weight is exerted on said work surface.

10. An adjustable height table as defined in claim 9, wherein:

a) said support includes a plurality of holes defined therein; and b) said lock-out member includes a spring-loaded pin configured for releasably mating with said holes.

11. An adjustable height table as defined in claim 10, wherein:

a) a release member is operatively associated with said spring-loaded pin for disengaging said pin from said holes.

12. An adjustable height work table as defined in claim 9, wherein:

a) said support includes a plurality of vertically spaced apart holes defined therein; and b) said lock-out member includes a spring-loaded pin configured for releasably mating with said holes.

13. An adjustable height work table as defined in claim 12, wherein:

a) a release member is operatively associated with said spring-loaded pin for disengaging said pin from said holes.

14. An adjustable height work table as defined in claim 9, wherein:

a) said element for variably fixing the distance between said work surface and the ground includes a plurality of vertically spaced apart holes defined in said support; and b) said lock-out member includes a pin configured for releasable mating with said holes.

15. An adjustable height work table as defined in claim 14, wherein:

a) a plate member is provided on said support;

b) a groove is defined in said pin; and c) said groove is configured for engaging said plate member and for preventing movement of said pin when said groove is engaged with said plate member.

16. An adjustable height work table, as defined in claim 14, wherein:

a) a tapered free end is provided on a free end of said pin; and b) said support includes a bevelled opening adjacent each said hole, each said bevelled opening being configured for guiding said tapered end of said pin into a respective one of each said hole.

17. An adjustable height work table as defined in claim 9, wherein:

a) said work surface is a substantially horizontal chevron-shaped element.

18. An adjustable height table as defined in claim 9, wherein:

a) said lock-out member is movable between an engaged position preventing movement of said work surface and a disengaged position allowing movement of said work surface, and said lock-out member is normally in said engaged position.

19. An adjustable height work table, as defined in claim 9, wherein:

a) said support includes a plate having a plurality of spaced apart holes defined therein;

b) said lock-out member includes a pin configured for releasably mating with each said hole; and, c) a groove is defined in said pin, said groove is configured for engaging said plate for restricting movement of said pin when said groove engages said plate.

20. An adjustable height work table, as defined in claim 19, wherein:

a) said groove includes:

i) an inclined ramp, and said inclined ramp is configured for sliding relative to said plate; and ii) a locking wall, and locking wall is configured for engaging said plate for precluding movement of said pin relative to said plate.

* * * * *